United States Patent [19]

Kobayashi

[11] 4,164,096

[45] Aug. 14, 1979

[54] RECIPRO-FINISHING METHODS AND MACHINES

[75] Inventor: Hisamine Kobayashi, Nagoya, Japan

[73] Assignee: Kabushiki Kaisha Shikishima Tipton, Nagoya, Japan

[21] Appl. No.: 801,406

[22] Filed: May 27, 1977

[30] Foreign Application Priority Data

Jul. 22, 1976 [JP] Japan ..... 51/97785[U]

[51] Int. Cl.[2] ..... B24C 31/00; B24C 1/00

[52] U.S. Cl. ..... 51/7; 51/317

[58] Field of Search ..... 51/6, 7, 17, 317

[56] References Cited

U.S. PATENT DOCUMENTS

| | | | |
|---|---|---|---|
| 2,218,353 | 10/1940 | Gruenberg | 51/7 |
| 2,815,609 | 12/1957 | VonDerLinden | 51/7 |
| 3,898,767 | 8/1975 | Kobayashi | 51/7 |

*Primary Examiner*—Gary L. Smith

*Attorney, Agent, or Firm*—Wenderoth, Lind & Ponack

[57] ABSTRACT

Recipro-finishing methods and machines in and by which workpieces having a curved profile are subjected to both reciprocating and rocking movements in a finishing trough containing finishing media.

10 Claims, 14 Drawing Figures

RECIPRO-FINISHING METHODS AND MACHINES

BACKGROUND OF THE INVENTION

1. Field of the Invention

This invention relates to method of and apparatus for finishing the surfaces of workpieces, and more particularly to improved methods and apparatus of the recipro-finishing type in which workpieces such as automobile fenders having a curved profile are subjected to both reciprocating and rocking movements in a finishing trough containing finishing media.

2. Description of the Prior Art

Conventional surface finishing apparatuses of the recipro-finishing type disclosed herein usually are designed to finish the surfaces of workpieces by subjecting the workpieces to reciprocating movement in a finishing trough containing media, for instance, abrasive chips and, if necessary, appropriate amounts of water and chemical substances (referred to herein as "media"), and have their uses or applications in fields of surface processing such as polishing, pickling, chemical processing, electro polishing, chemical polishing and plating.

Practically all of the conventional apparatuses are disadvantageous with respect to surface-finishing workpieces having a curved profile such as automobile fenders, since they are only designed to process the workpieces by reciprocating them in a horizontal direction in a finishing trough and in some cases by vertical movement of the trough. It is difficult or almost impossible to obtain satisfactorily uniformly finished surfaces of the curved workpieces in this manner because of variations in the contact condition between the media and the workpiece to be finished, depending on the different angles of the workpiece surfaces and the different manners or degrees of the finishing operation. Thus, the surfaces are unevenly finished.

SUMMARY OF THE INVENTION

Having the above disadvantages in view and with a view to eliminating the same, it is one object of the present invention to provide improved methods and apparatus of the recipro-finishing type which permits both reciprocating and rocking movements of workpieces of curved profile, following the curved surface profile of the workpieces, thereby producing a uniform contact between practically all areas of the workpieces and the media and thus providing satisfactorily evenly finished surfaces.

It is another object of the invention to provide means for supplying reciprocating motion and means for supplying rocking motion which can be combined to cause the workpieces to follow the semi-circularly curved shapes thereof.

BRIEF DESCRIPTION OF THE DRAWINGS

Other objects and advantages of the present invention will become readily apparent by reading the remaining part of the specification and appended claims with the aid of the accompanying drawings, in which:

DETAILS OF THE PREFERRED EMBODIMENTS

Figure 2:
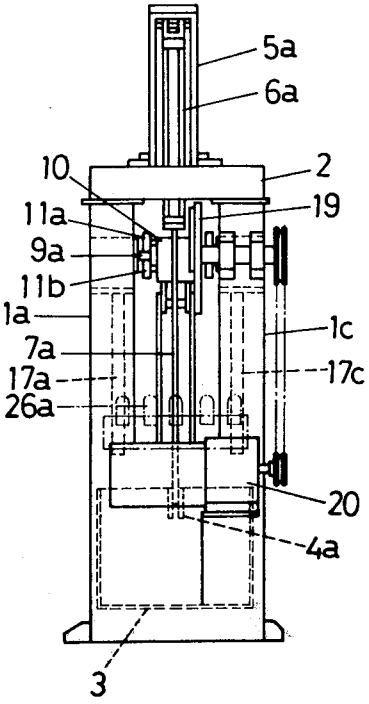
FIG. 2 is a side view of the machine of FIG. 1.
Figure 1:
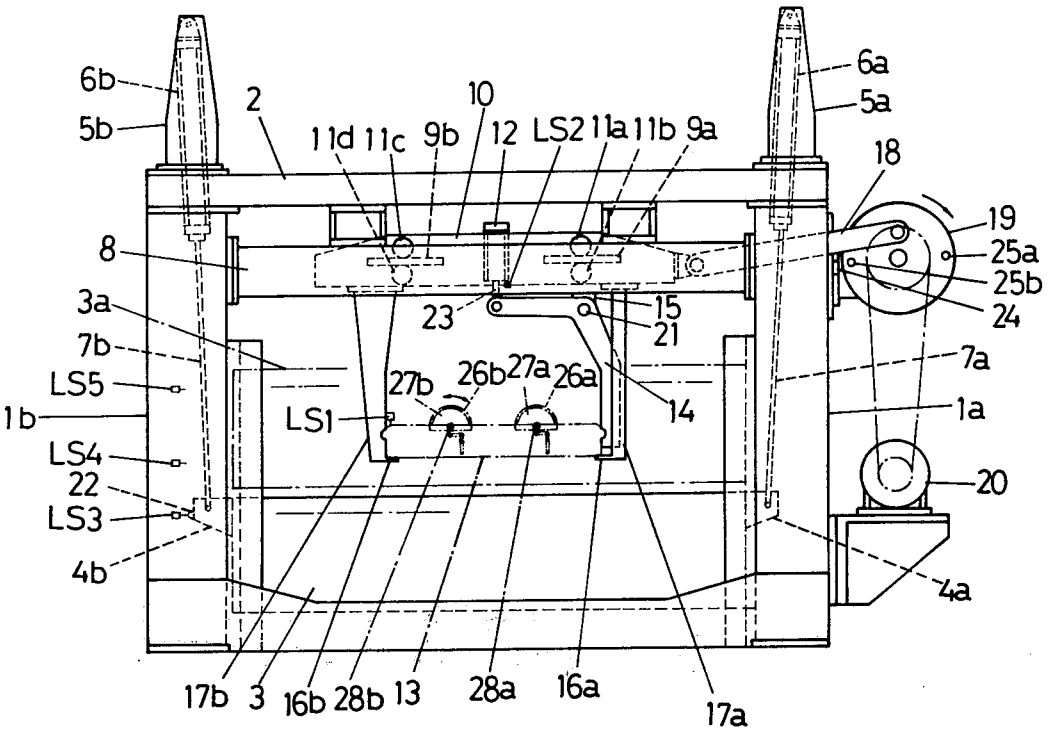
FIG. 1 is a front view showing the general construction of the recipro-finishing machine for use with the various examples of the improvement according to the invention.

Referring first to FIGS. 1 and 2, the recipro-finishing machine for use with the invention is generally shown, the machine including four supporting members or posts 1*a*, 1*b*, 1*c* and 1*d* and a top cover 2 rigidly fixed to the members 1*a*, etc. A transverse member 8 is connected between the members 1*a* and 1*b*, and has both ends rigidly secured thereto. The transverse member 8 has guide members 9*a* and 9*b* thereon. As shown, the guide members 9*a* and 9*b* are straight, but then may be curved. The shape thereof defines the path of travel which a workpiece follows when moved in horizontal directions in the media in the trough. A reciprocating arm 10 has pairs of guide rollers 11*a* and 11*b*, and 11*c* and 11*d* which are mounted on the arm 10 either rigidly or rotatably and which travel along the respective guide members 9*a* and 9*b*, thus guiding the arm 10 in opposite horizontal directions. One end of a crank arm 18 is fixed to the arm 10 for rotation through a small angle, the other end of the crank arm 18 being fixed to a rounded plate or disc 19 for eccentric rotation with the plate. The rounded plate 19 is connected by way of a belt or similar means to a main electric motor 20 for being driven for rotation on its axis. Thus, energizing the motor 20 causes the plate 19 to turn on its axis, the rotation of the disc 19 being translated to a reciprocating motion which moves the arm 10 in opposite horizontal directions.

Stationary arms 17*a* and 17*b* depend from the underside of the arm 10 and have rails 16*a* and 16*b* at the lower ends thereof. The rails 16*a* and 16*b* are positioned on a level with rails for use in setting a separate magazine 13 in position and removing the same. The magazine 13 carries a workpiece to be finished, and is placed in position on the machine or is removed therefrom by traveling along the rails 16*a* and 16*b*. Rigidly secured to one side of the arm 10 is a flange 15, the flange 15 carrying a shaft bearing which supports for rotation a shaft 21 of a clamp arm 14 having a bell crank form as shown. The upper end of the clamp arm 14 is connected for rotation through small angles to a piston rod 23 of a cylinder 12 for driving the clamp arm 14, which in turn is secured to the reciprocating arm 10. Thus, the lower end of the clamp arm 14 can be operated to place the magazine 13 in position and release it by means of the piston rod 23 which moves up and down. Reference numeral 3 denotes a finishing trough which has flanges 4a and 4b on both sides. The top cover 2 has cylinder housings 5a and 5b which extend upwardly and in which cylinders 6a and 6b are accommodated for pivotal movement around their upper ends through small angles, respectively. The cylinders 6a and 6b have the respective piston rods 7a and 7b extending downwardly and connected to the corresponding flanges 4a and 4b. Thus, when the cylinders 6a and 6b are operated, the piston rods 7a and 7b move up and down, causing the finishing trough 3 to move up and down therewith. The elevated position of the trough 3 is indicated by broken lines at 3a in FIG. 1.

A micro switch 24 is provided on the support member 1a, which operatively controls the reciprocating arm 10 so that the arm 10 can be stopped at the central position. The disc 19 has iron pieces 25a and 25b at diametrically opposite points, and an electric circuit not shown is provided so that it can turn the motor 20 at a very low speed until the iron piece 25a or 25b is placed opposite the micro switch 24 at the time when one cycle of the finishing operations is completed.

Now, the various forms and structures of the magazine 13 which is open above and below and for carrying workpieces 26 generally having a curved profile are described below in more detail. One example of the structure including the magazine shown in FIG. 3 includes a workpiece mounting plate generally designated at 27 to which a workpiece 26 is secured by means of a set screw 29. The mounting plate 27 has a shaft 28 therethrough and is secured thereto, the two ends of the shaft 28 being rotatably mounted in the corresponding walls of the magazine 13. As shown, the shaft 28 further carries one end of a bell crank 30, the other end of the crank 30 being pinned by way of a connecting member 34 to a flange 32 rigidly fixed to a blade 31 for pivotal movement through small angles. A further shaft 33 passes through the flange 32 and supports the blade 31, the shaft 33 having the ends connected to the corresponding walls of the magazine 13.

Figure 3:
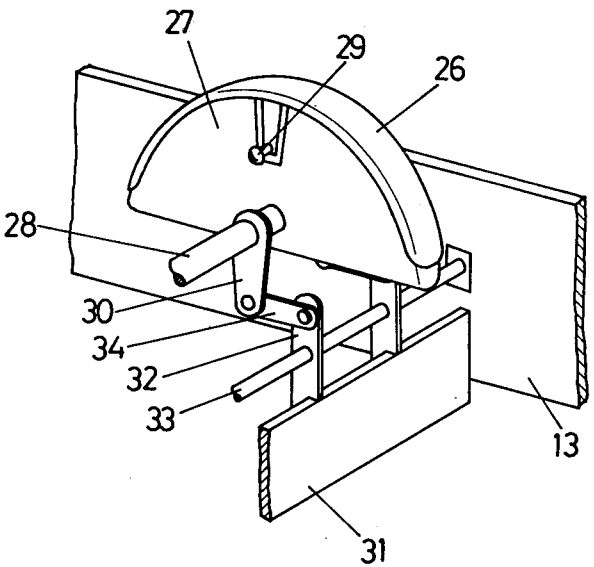
FIG. 3 is a perspective view of a first embodiment of the improvement according to the invention.

In accordance with the embodiment described above, the operation will now be described by referring to FIGS. 1, 2 and 3 for better understanding of the construction of the invention. The apparatus according to the invention may be designed so that it can be automatically operated under control of a sequence control circuit which includes limit switches (hereinafter referred to as "LSxx") and timers (hereinafter referred to as "TM") which provide signals to cause the apparatus to perform a sequence of operations one cycle after another. Otherwise, the apparatus may be designed so that it can be manually operated, in such a way that each time one cycle of the finishing operation is completed, an operator, who confirms the completion of each cycle, intervenes to operate the apparatus to proceed to a next cycle of operation. It should be understood that both automatic and manual operations fall within the scope of the present invention. For convenience, clarity and a better understanding of the construction of the apparatus, the following description concerns only the automatic operation, and the manual operation purposely not described is performed without use of the sequence control circuit which is actuated by use of limit switches LS and timers TM.

Other varied forms of the apparatus which will be described hereinafter are also operated under control of the sequence control circuit above mentioned, and they are designed to operate automatically although they may also be designed for manual operation.

For clarity and simplicity, one workpiece or magazine is typically illustrated below unless otherwise specified. Before introducing workpieces 26a, 26b, etc. to be finished into the surface-finishing machine, workpieces are first placed in position on corresponding workpiece mounting plates 27 of the magazine 13 which in turn is transported by separate transport means not shown on rails 16a and 16b which are led into the machine. As the workpiece mounting plate 27 is set in position on the machine, LS1 which is actuated by the transport means detects that the plate 27 has been positioned, causing a pressurized fluid to be introduced into the piston rod side of the clamp arm drive cylinder 12 which in turn pivots the clamp arm 14 in a direction for tightly holding the magazine 13 for the plate 27. This holding operation is sensed by LS2 provided at the open end of the cylinder 12, and LS2 delivers a signal which energizes the main electric motor 20 and also causes a pressurized fluid to be introduced into the piston rod side of the drive cylinders 6a and 6b, thus moving the finishing trough 3 up toward the workpiece mounting plate 27 which then becomes submerged in the media in the trough 3. In this state, the plate 27 carrying the workpiece is subjected to a reciprocating motion. During the reciprocation of the plate 27, the movement of the blade 31 through the media applies pressure to the blade 31, which in turn gives the workpiece a rocking motion together with the mounting plate 27 by way of the bell crank 30, thus causing both reciprocating and rocking movements of the workpiece in the trough 3. In some cases where it is desirable, it may be possible to move the trough up and down during the reciprocating movement of the workpiece. In those cases, LS4 and LS5 may be provided at two locations between the cylinder 6b and the flange 4b within the stroke of the piston rod 7b in order to define the upper and lower limits of the stroke of the cylinder 6a and 6b.

The time of operation of the machine during which one cycle of the finishing operation is to be carried out is controlled by means of a timer, which delivers at the end of each cycle a signal which triggers a micro switch 24 to turn on, the switch 24 delivering a signal by detecting the arrival of the iron piece 25a or 25b close thereto for deenergizing the main motor 20 and causing a pressurized fluid to be introduced into the piston sides of drive cylinders 6a and 6b for lowering the trough 3 to a predetermined position. In order to detect the position on which the trough is completely lowered, there is provided a dog 22 on the flange 4b which depresses LS3 secured to the support member 1b, causing a pressurized fluid to be introduced into the piston side of the clamp arm cylinder 12 with releases the magazine 13 from the clamp arm 14. This release action of the clamp arm 14 is detected by LS2 which operates the magazine transport means for withdrawing the magazine 13 from the machine. Thereafter, a next cycle of the aforementioned operations will be started again, if those operations are automatically carried out.

For operations in which the finishing operation involves a flow of electric current through a workpiece, such as electropolishing, plating, electrolytic cleaning and the like, it is necessary only to keep the magazine electrically isolated from the rest of the machine and supply it with electricity which is applied between electrodes (not shown) in the trough 3.

Figure 5:
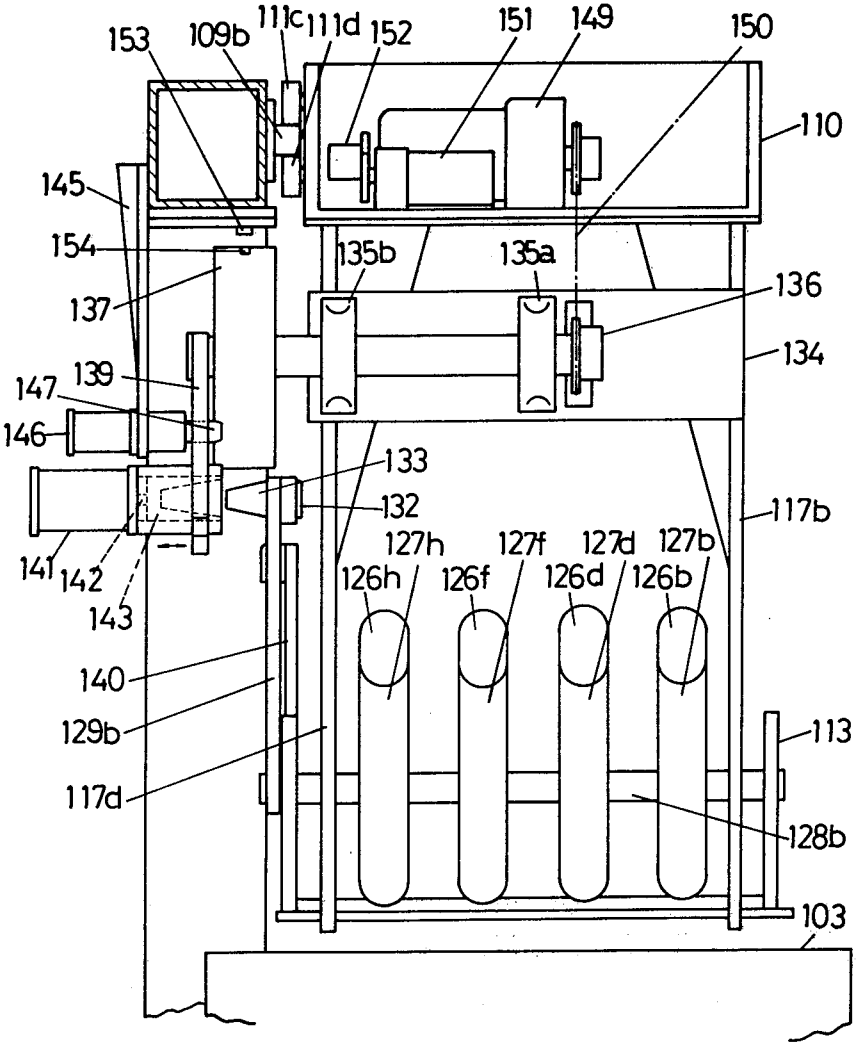
FIG. 5 is a side view of the embodiment of FIG. 4 seen from the left side.
Figure 4:
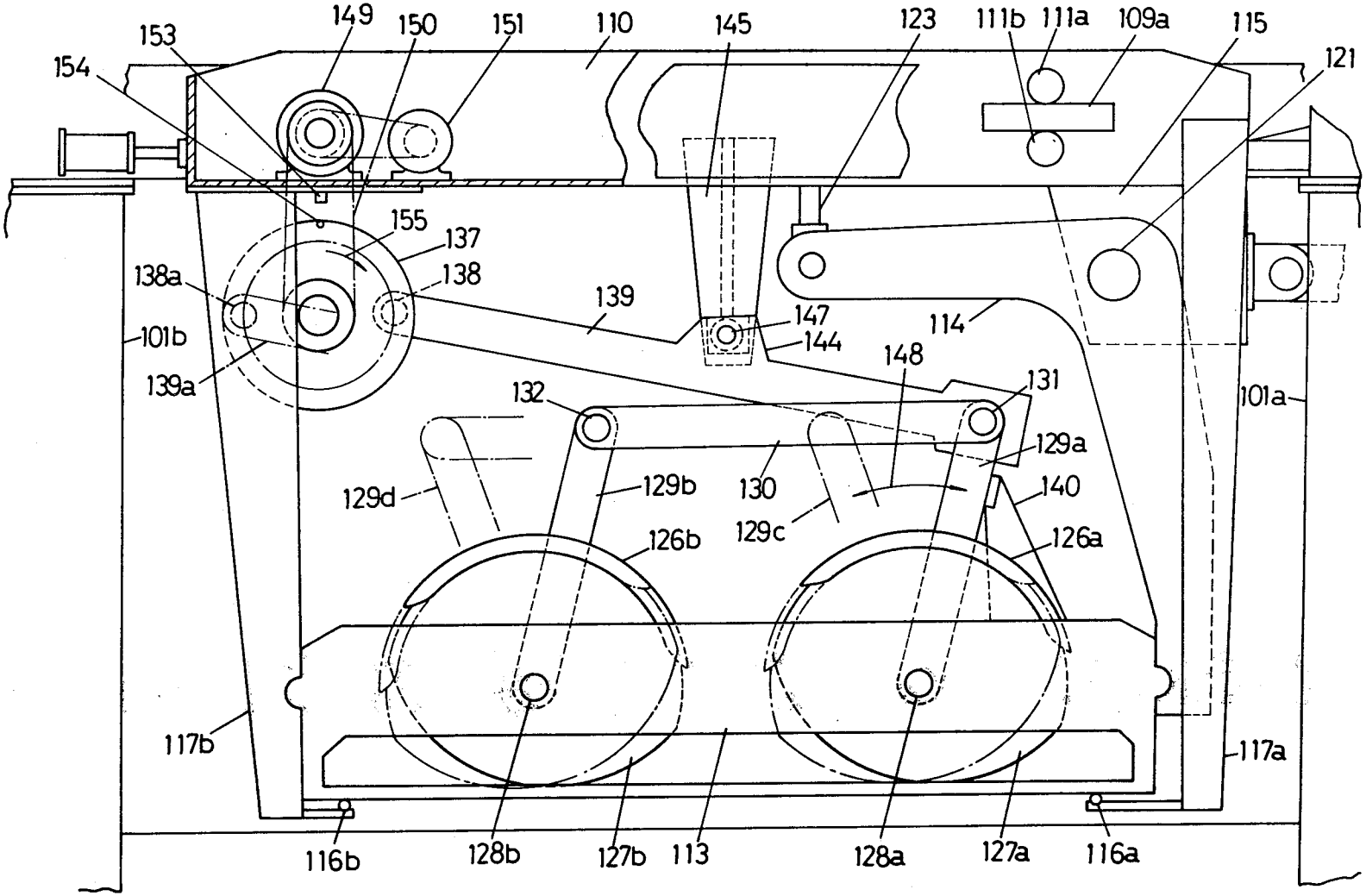
FIG. 4 is a front view, on an enlarged scale, of a second embodiment.

FIGS. 4 and 5 show a second preferred embodiment of the magazine in which a workpiece having curved profile is to be mounted firmly, and the construction by which the magazine is mounted in position on the machine. In illustrating this embodiment, for clarity of understanding, the corresponding parts have reference numerals the same as those in FIGS. 1–3 but increased by one hundred in FIGS. 4 and 5. Those parts common to FIGS. 1 and 2 are not described for simplicity, but only the parts specific to the embodiment of FIGS. 4 and 5 are described. A magazine 113 is provided with bearings in which are rotatably mounted corresponding shafts 128*a* and 128*b* for mounting plates. Secured to the shafts 128*a* and 128*b* are workpiece mounting plates 127*a*, 127*b*, 127*c* etc. which have profiles corresponding to those of workpieces, 126*a*, 126*b*, 126*c* etc. and workpieces are fitted around the semi-circular periphery of the corresponding mounting plates as shown. Secured to one ends of shafts 128*a* and 128*b* are corresponding links 129*a* and 129*b* to which a connecting link 130 is fixed for pivotal movement by way of pins 131 and 132. The pin 131 has a projection 133 extending axially thereof. A base 134 for a rocking device is secured to stationary arms 117*b* and 117*d* on which two bearings 135*a* and 135*b* are secured as shown in FIG. 5 for rotatably supporting shaft 136 of the rocking device, one end of the shaft 136 having an eccentric wheel 137 for the rocking device secured thereto. Secured to the eccentric wheel 137 is a pin 138 to which one end of a rocking lever 139 is pivotally connected, and secured to the other end of the rocking lever 139 is a drive cylinder 141 as shown in FIG. 5, the piston rod of which has a connector 143 at its outer end. There is an apertured flange 144 which is fixed to the intermediate portion of the rocking lever 139, and above the lever 139 is fixed in position a cylinder support arm 145 secured to a reciprocating arm 110. Secured to the arm 145 is a fluid cylinder 146, and when the pin 138 is in the right hand position as shown in FIG. 4, the piston rod 147 of the cylinder 146 projects out of the cylinder 146, and enters and engages the aperture in the flange 144, placing the rocking lever 139 in a fixed position. In this position of the lever 139, links 129*a* and 129*b* have their positions controlled by a stop 140 secured to the magazine 113, and the piston rod 142, as it projects, causes the connector 143 to engage the projection 133 and the piston rod 147 is moved away from the aperture of the flange 144, causing the lever 139 to rock the links 129*a* and 129*b* as indicated by arrow 148 back and forth between the full line positions 129*a* and 129*b* to the broken line positions 129*c* and 129*d* in FIG. 4. It will be readily understood from the above that the rocking motion is then imparted to the magazine or workpiece, which rockably travels following a semi-circularly curved path. In further detail, the workpiece reciprocates by means of the reciprocating arm 110, and, if necessary, is also moved up and down by the movement of the cylinders 106*a* and 106*b*, permitting the rocking motion of the workpiece to be effected along a curved path. In order to produce the above rocking motion, the rocking device includes the eccentric wheel 137 described earlier which is rotated by means of a rocking motor 149 by way of a belt 150 in the direction of arrow 155 in FIG. 4, thus causing the rocking lever 139 to have a rocking motion. Means to stop the rocking device in position includes an index motor 151 which is connected by way of a cam clutch 152 to the shaft of the rocking motor 149 for driving the shaft of the motor 149 for inching rotation, the cam clutch 152 having the function of imparting the rotation of the motor 151 to the shaft of the motor 149 and also of preventing the rotation of the rocking motor 149 from being imparted back to the motor 151. The eccentric wheel 137 can be controlled by means of the micro switch 153 and iron piece 154 on the wheel 137 as described in the earlier embodiment so that it can be stopped in position.

The operation of the construction shown in FIGS. 4 and 5 will be described below by reference to FIGS. 1, 2, 4 and 5. Before loading workpieces 126*a*, 126*b* etc. to be finished onto the machine, the workpieces are first firmly mounted in position on the corresponding mounting plates 127*a*, etc., which with the link 129*a* in contact with the stop 140 are transported by separate transport means not shown on the rails 116*a* and 116*b* into the machine. The completion of loading of the mounting plates in the machine is detected by LS1 on one of the stationary arms which is depressed by a dog not shown on the magazine 113. At this time, the piston rod 147 is projecting out of the cylinder 146, supporting the flange 144 of the rocking lever 139. This means that the connector 143 and projection 133 are placed opposite each other. Then, LS1 delivers a signal to introduce a pressurized fluid into the piston rod side of the cylinder 112 which in turn operates the clamp arm 114 for tightly holding the magazine 113 in position. The holding of the clamp arm 114 is detected by LS2 at the open end of the cylinder 112 which delivers a signal to energize the main motor 120 and rocking motor 149, the latter causing a pressurized fluid to be introduced into the piston rod sides of the cylinders 106*a* and 106*b*, which in turn move the trough 103 upwardly. With the trough 103 in the elevated position, the workpieces effect both reciprocating and rocking motions which follow a generally semi-circularly curved path. Similarly to the earlier embodiment shown in FIGS. 1, 2 and 3 the operation is performed in the sequence described, and for avoiding complexity of explanation, this description is omitted.

Figure 6:
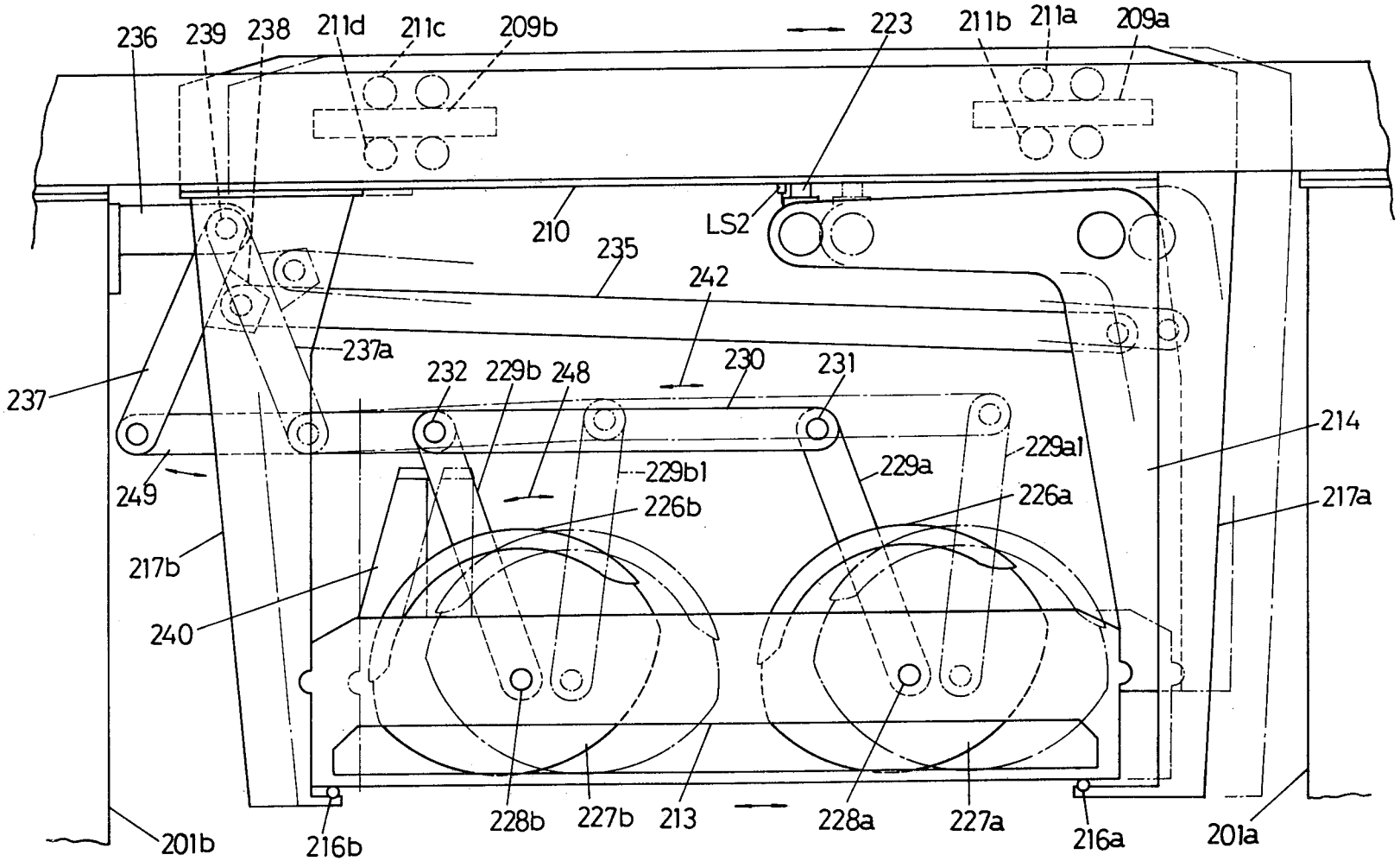
FIG. 6 is a front view, on a partly enlarged scale, showing in detail the movement of the moving parts of the construction according to a third embodiment.
Figure 7:
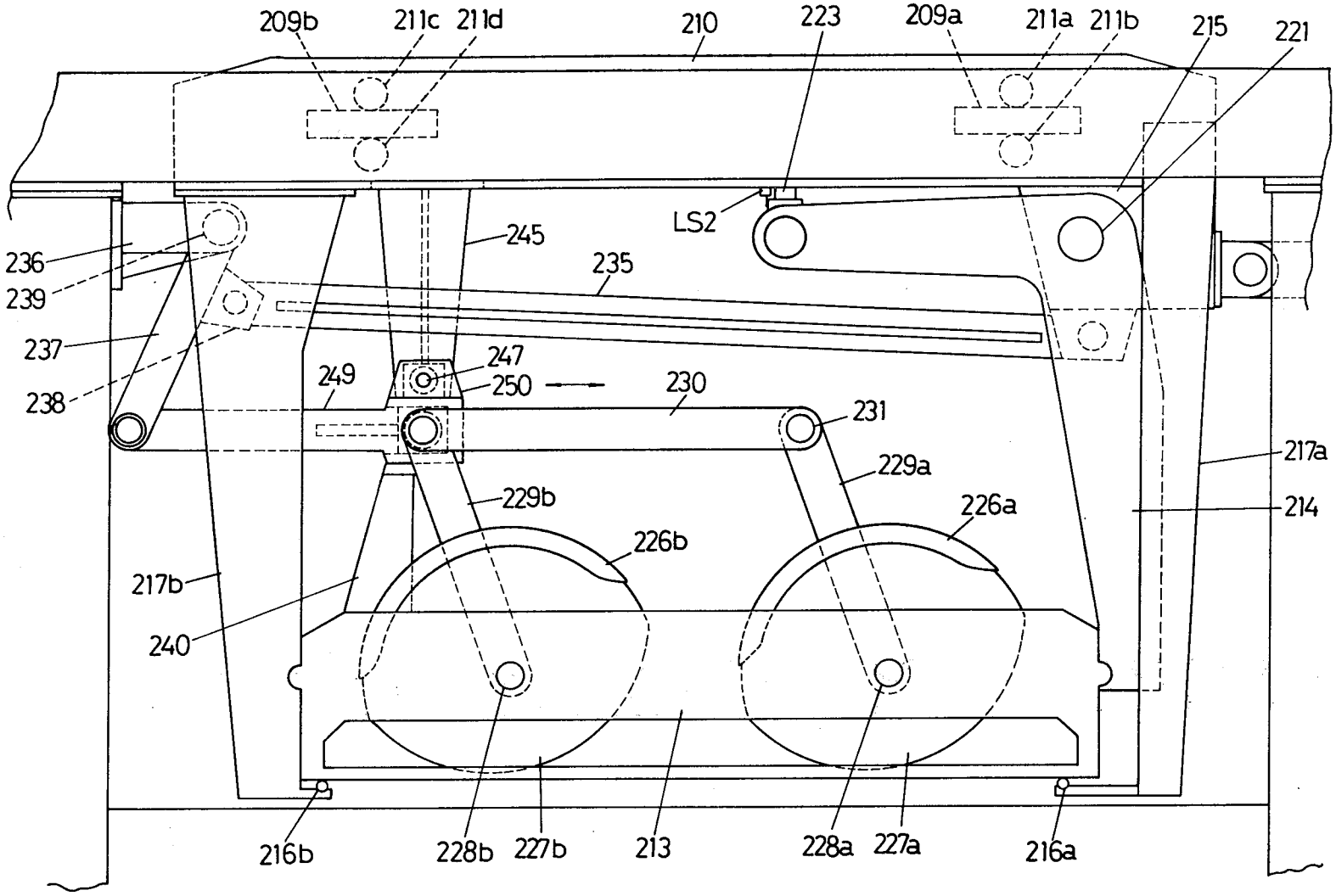
FIG. 7 is a front view, on a partly enlarged scale, showing details of the embodiment of FIG. 6.
Figure 8:
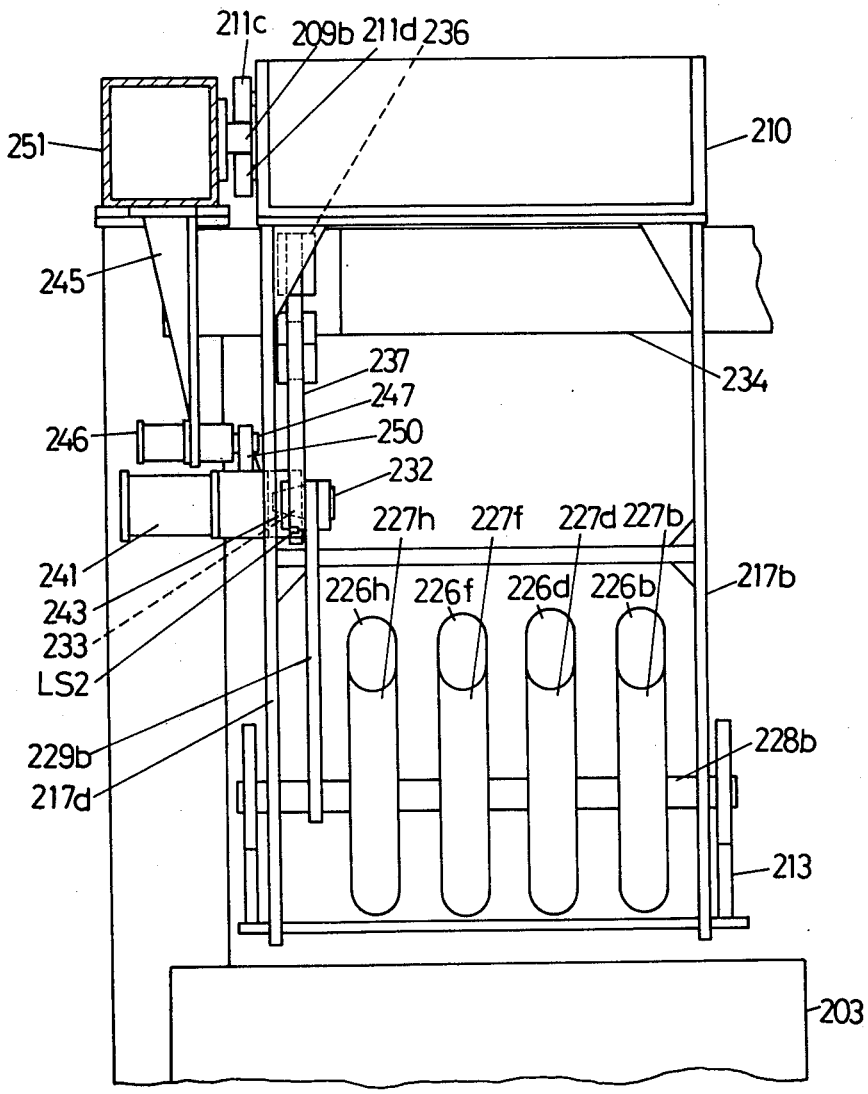
FIG. 8 is a side view of the embodiment of FIG. 7.

A third embodiment which is a variation of the second embodiment is illustrated in FIGS. 6 to 8, in which the general construction of the finishing machine is similar to that in FIGS. 1 and 2, and corresponding parts have reference numerals which are the same as those of FIGS. 1 and 2 but increased by two hundred. Therefore, reference should be made to the discussion of FIGS. 1 and 2 for the functions of those common parts not described below. A magazine 213 has bearings in which are rotatably mounted shafts 228*a* and 228*b* for mounting plates. Secured to the shafts 228*a* and 228*b* are mounting plates 227*a*, 227*b*, 227*c*, etc. each having the shape of a workpiece 226*a*, 226*b*, 226*c*, etc. having a curved profile, and the workpieces are firmly mounted in position around the semi-circular periphery of the corresponding mounting plates 227*a*, etc. Secured to one ends of the shafts 228*a* and 228*b* are corresponding links 229*a* and 229*b* which are pivotally connected by a connecting link 230 by way of pins 231 and 232. The pin 232 has a projection 233 extending axially thereof. A base 234 for the rocking device is fixed to the stationary arms 217*a* and 217*c*, to which one end of a lever 235 is connected pivotally for rotation through small angles. As shown in detail in FIG. 6, the other end of the lever 235 extends toward the left side of the figure above the link 230, and is pivotally mounted on the intermediate projection 238 on a lever 237 pivotally mounted on a flange 236 fixed to the support member 201*b*. Secured to one end of the lever 237 is a reciprocating arm 249 which has an apertured projection 250 thereon as shown in FIG. 7. Mounted behind the reciprocating arm 210 is a stationary beam 251 as shown in FIG. 8, from which depends a support 245 on the end of which is a cylinder 246 the piston rod 247 of which has a tip engageable in the aperture in the projection 250 when the arm 249 is in the left position which will be described in detail later. Fixed on the end of the arm 249 is a drive cylinder 241, and when the magazine 213 is in position in the machine with the link 229*b* in abutment with a stop 240 as shown in FIG. 7, the projection 233 on the end of the link 229*b* and the recessed portion of the connector 243 on the end of the piston rod of the cylinder 241 engage each other. At the position described above, the piston rod 247 is placed opposite the aperture of the projection 250. Generally, the operation is similar to the earlier embodiments, but is carried out specially in the present embodiment. For a better understanding of the embodiment in FIG. 7, the operation is explained below. Before loading workpieces 225*a*, etc. to be finished into the machine, the workpieces are firmly placed in position on corresponding mounting plates 227*a*, etc. and with the link 229*b* abutting the stop 240 are transported by transport means not shown into the machine. The completion of loading is detected by LS1 on one of the stationary arms which is depressed by a not shown dog on the magazine 213 for the mounting plates 227*a*, etc., and the projection 250 on the arm 249 and the piston rod 247 of the cylinder 246 are also engaged and the connector 243 and projection 233 are positioned opposite each other. LS1 then delivers a signal to introduce a pressurized fluid into the piston rod side of the cylinder 246 and also to introduce a fluid into the piston side of the cylinder 241, causing the arm 249 to be released from its fixed condition and thus causing the arm 249 and link 230 to be connected to each other. This connection is detected by LS2 on the periphery of the connector 243 which is depressed by the link 229*b*, causing a pressurized fluid to be introduced into the piston rod side of the clamp arm cylinder 212 (not visible in FIGS. 6 and 7) which actuates the clamp arm 214 to hold the magazine 213 tightly. The holding of the clamp arm 214 is detected by LS2 on the open end of the cylinder 212, which delivers a signal to energize the main motor 220, thus introducing a fluid into the piston rod side of the drive cylinders 206*a* and 206*b*, thereby moving the trough 203 up, after which the magazine 213 effects reciprocating motion while causing the right side end of the lever 235 to reciprocate together with the stationary arm 217*a*. However, because the upper end of the lever 237 is pivoted on pin 239 which is fixed to support member 201*b*, the lever 237 effects a rocking motion from the full line to the broken line position shown in FIG. 6, thus causing the link 230 to reciprocate in the direction of arrow 242 and accordingly to effect a rocking motion of links 229*a* and 229*b* between positions 229*a* and $229a_1$, and 229*b* and $229b_1$, thereby subjecting the magazine 213 to a rocking motion indicated by arrow 248 in FIG. 6. The operations are performed in the same manner as described in the first embodiment.

Figure 9:
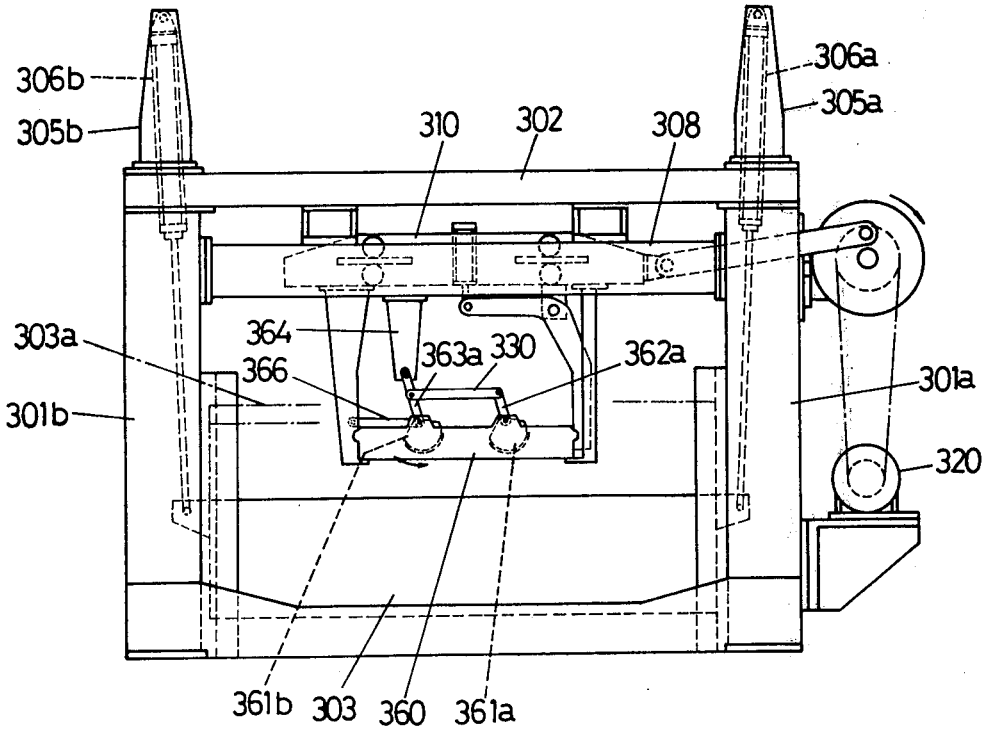
FIG. 9 is a front view of a variation of the recipro-finishing machine for use with the construction of FIG. 7.
Figure 10:
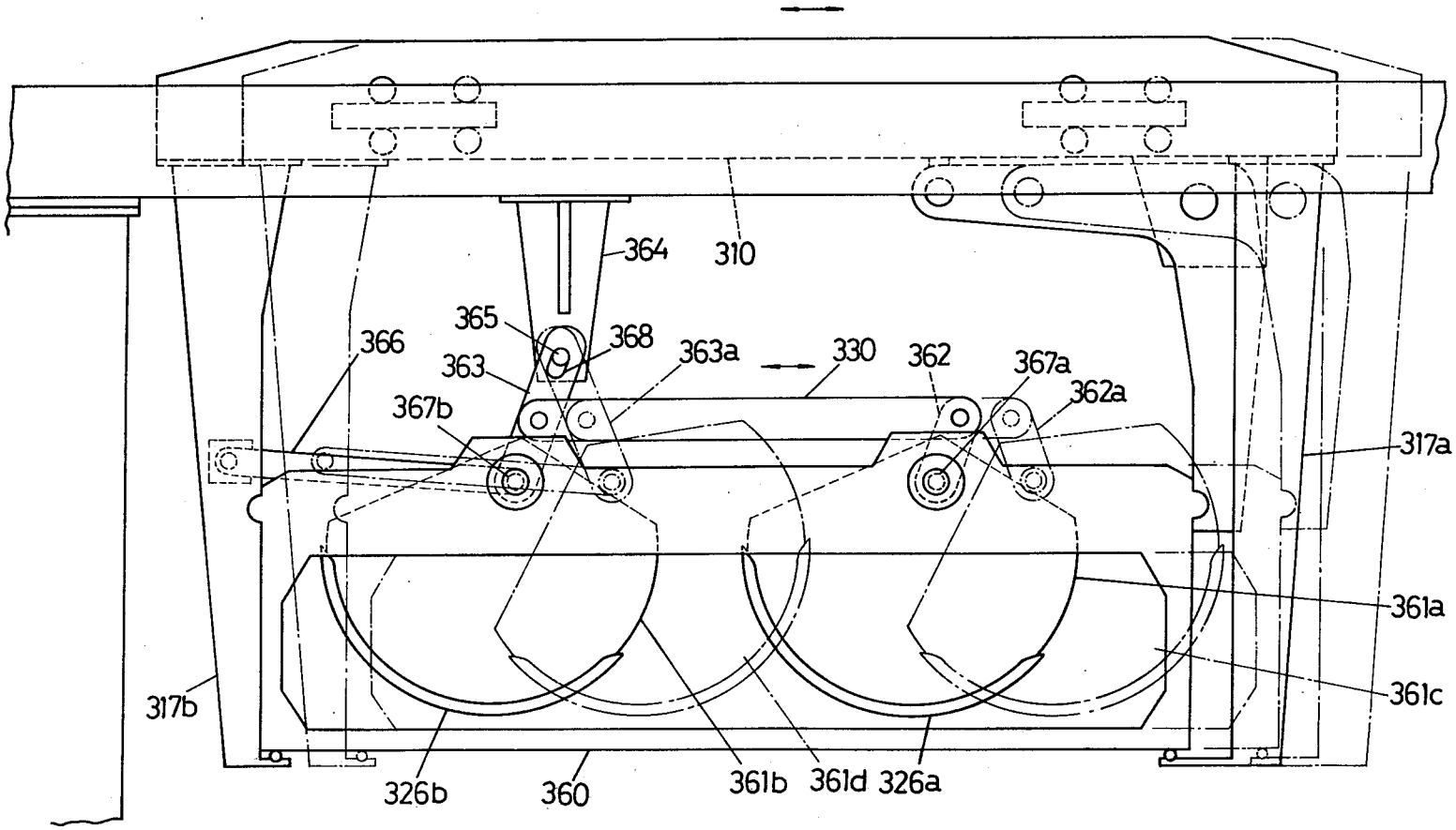
FIG. 10 is a front view, on a partly enlarged scale, showing in detail the movement of the moving parts of the construction according to a fourth embodiment.
Figure 11:
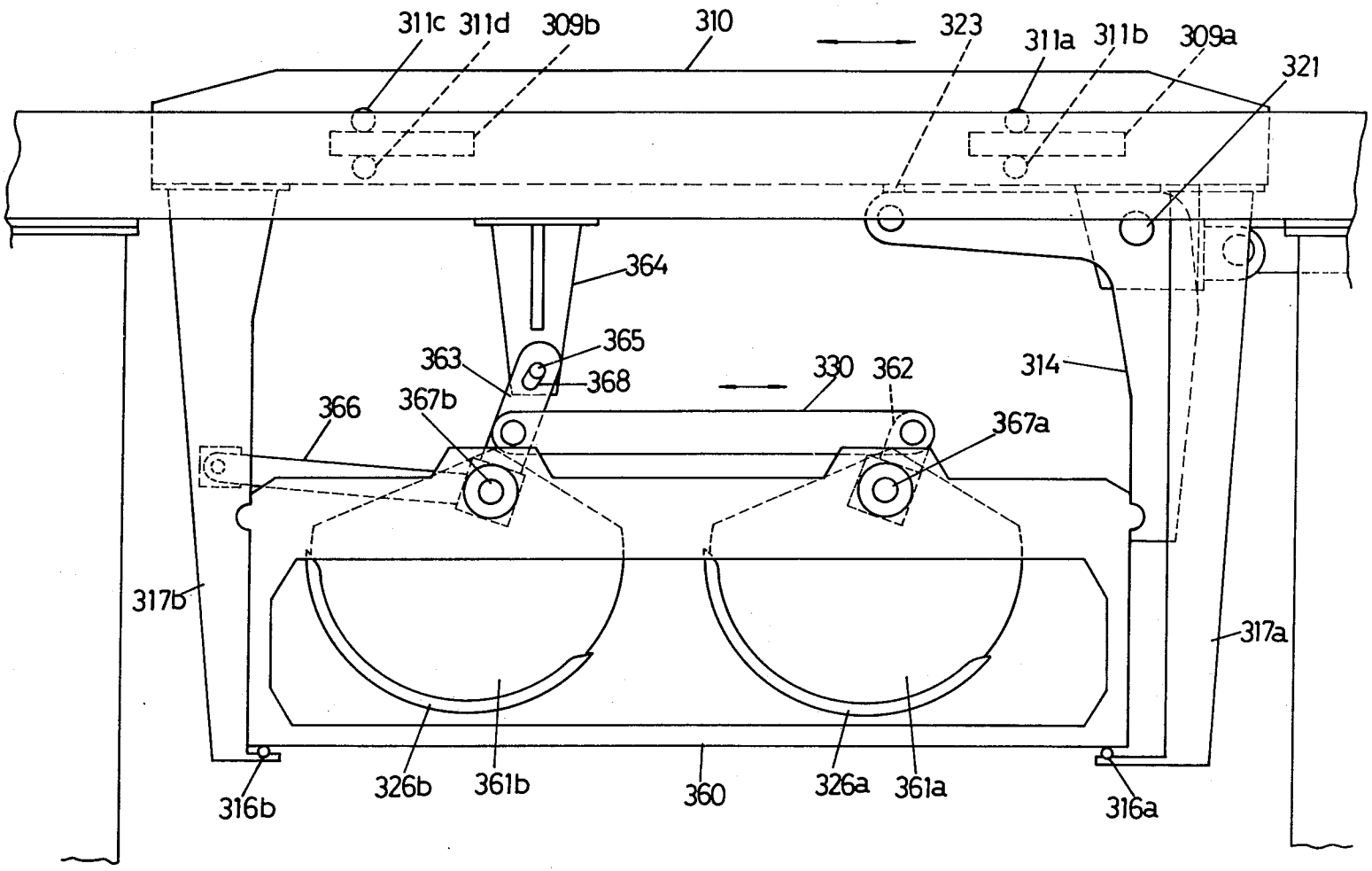
FIG. 11 is a front view, on a partly enlarged scale, showing details of the embodiment of FIG. 10.

A fourth embodiment is shown in FIGS. 9 to 11, and is now described below. Some of the parts common to the ebodiment of FIGS. 1 and 2 are not shown, but those should be understood to function similarly to FIGS. 1 and 2. Therefore, those parts and others are designated by numerals increased by three hundred. In FIGS. 10 and 11, a magazine 360 has a box shape open below, above which a mounting plate shaft bearing is provided. Workpiece mounting plates 361*a* 261*b*, etc. are carried by shafts 367*a* and 367*b*, respectively, which in turn are supported by the aforementioned bearing for pivotal movement through small angles. Workpieces 326*a*, 326*b*, etc. having a curved profile are firmly mounted on the fixture plates 361*a*, 361*b*, etc. as shown. Secured to the shafts 367*a* and 367*b* are corresponding links 362 and 363, at least one of which, link 363, has at its upper end an elongated aperture 368 in which is engaged a pin 365 for pivotal and sliding movement, said pin 365 being carried by a cylinder support arm 364 fixed to a traverse frame member 308. The links 362 and 363 are connected by a connecting link 330 one end of which is pinned to the link 362 and the other end of which is pinned to the intermediate portion of the link 363, for turning the links 362 and 363 through small angles. The stationary arm 317*b* has connected thereto at an intermediate portion thereof a stationary arm 366 by, for example, welding, and has at its free end a drive cylinder the same as the drive cylinder 341 described in connection with the third embodiment in FIG. 8. The mounting plate 367*b* has a pointed axial projection like that shown at 233 in FIG. 8. The operation of the above described embodiment is as follows. It should be noted that a fluid cylinder such as cylinder 246 in FIG. 8 is not required because the arm 366 is rigidly secured to the stationary arm 317*b*. When the main motor 320 is turned on, it causes the reciprocating arm 310 to reciprocate in the same manner as the apparatus of FIGS. 1 and 2, thus causing reciprocating motion of the arm 366. Since the cylinder support arm 364 is rigidly secured to the transverse frame member 308 and the axial projection on mounting plate 367*b* is connected to the drive cylinder structure on the free end of arm 366, the reciprocation of the arm 366 results in rocking the levers 362 and 363 between the positions shown by the full lines and by the broken lines 362*a* and 363*a*, which in turn produces rocking motion of the mounting plates 361*a*, 361*b* etc. between the full line positions and the positions 361*c* and 361*d* shown by the broken lines, respectively.

Figure 13:
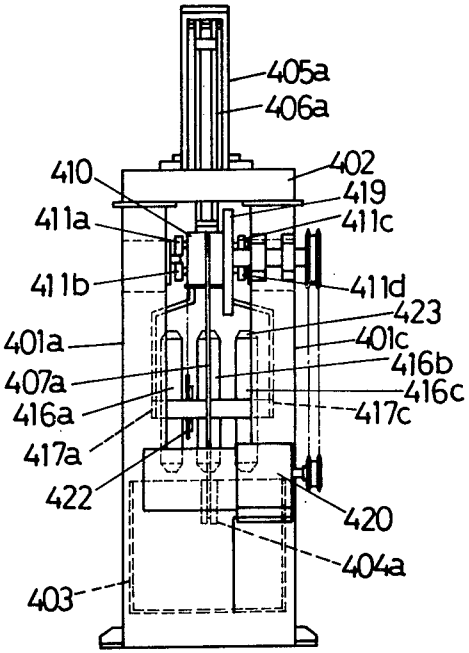
FIG. 13 is a side view of the embodiment of FIG. 12.
Figure 12:
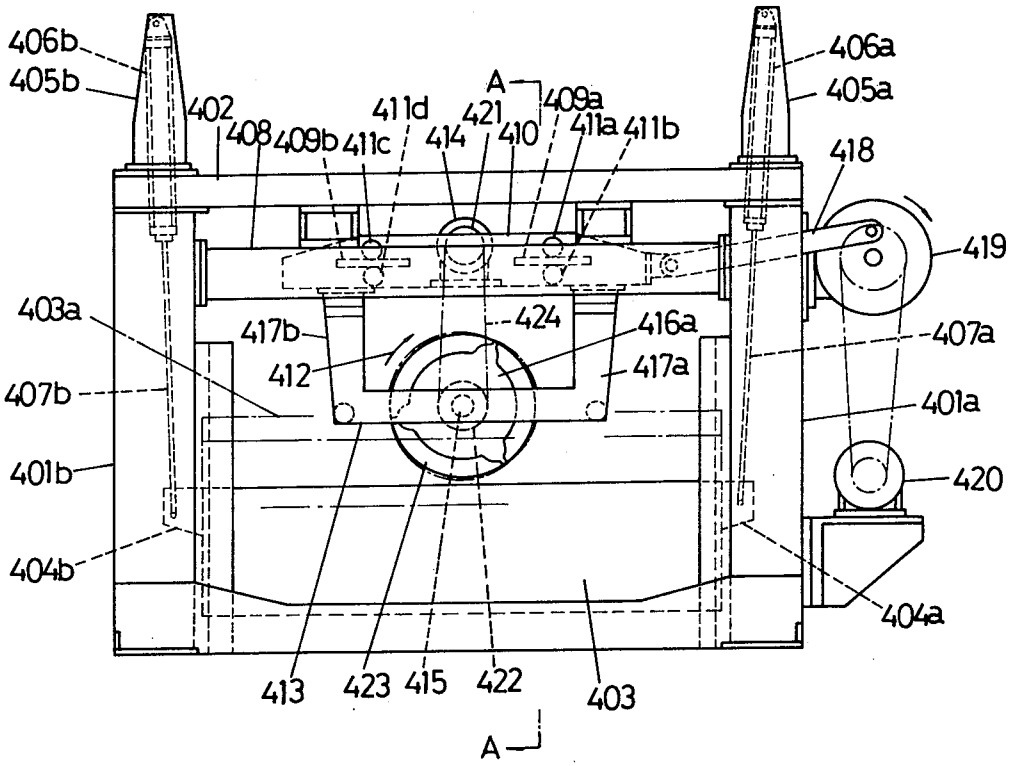
FIG. 12 is a front view of a fifth embodiment.
Figure 14:
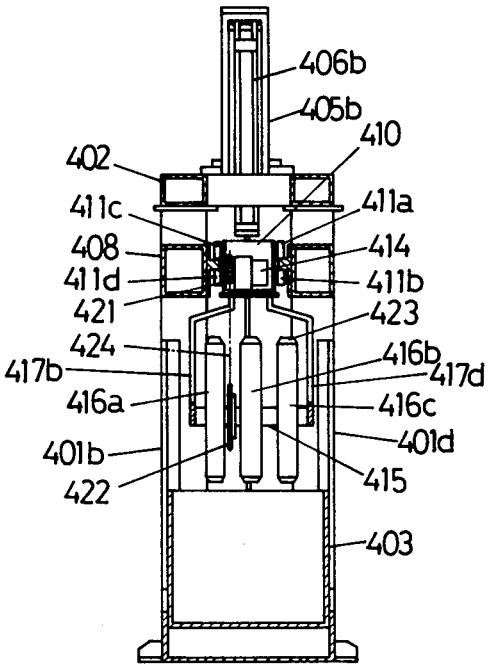
FIG. 14 is a sectional view taken along the line of A—A in FIG. 12.

A fifth embodiment is shown in FIGS. 12 to 14. The finishing machine has a rotating mechanism and the reciprocation and the other construction is generally similar to that shown in FIGS. 1 and 2. Therefore, corresponding parts have corresponding numerals but increased by four hundred. Reference should be made to FIGS. 1 and 2 for the construction and function of those corresponding parts. Secured to the underside of the reciprocating arm 410 are stationary arms 417*a*, 417*b*, 417*c* and 417*d* for holding a workpiece magazine typically shown at 413. The magazine 413 carries a shaft 415 rotatably supported by bearings and driven by motor 414 provided centrally on the reciprocating arm 410. The motor 414 has a sprocket 421 which is operatively connected with a sprocket 422 on the shaft 415 by a chain 424. As shown in FIGS. 13 and 14, the workpiece mounting shaft 415 has a number of workpiece mounting devices 416*a*, 416*b* and 416*c* thereon to which workpieces generally shown at 423 are firmly fixed in position as shown, and each having the shape of a workpiece with a curved profile. Energizing the motor 414 drives the chain 424 for rotating the shaft 415, which in turn rotates the workpieces 423. Thus, the workpieces 423 are simultaneously given a reciprocating motion caused by the reciprocating arm 410 and a rotating motion caused by the shaft 415, and during the above two motions of the workpieces, if necessary, the trough 403 may be driven in alternative up and down movement. At the start of the operation of the embodiment of FIGS. 12 to 14, similar to the aforedescribed various embodiments, before loading workpieces 423 to be finished into the surface finishing machine, the workpieces are first firmly placed in position on the corresponding workpiece mounting devices 416*a*, etc., and then fixed to the magazine 413. The magazine 413 is thereafter firmly engaged by the stationary arms 417*a*, etc., and then the main motor 420 is turned on, causing the motor 414 to turn which introduces a pressurized fluid into the piston rod sides of the drive cylinders 406*a* and 406*b*, causing the trough 403 to move up. Thus, the workpieces are subjected to the finishing process during the reciprocating and rotating motions. Other operations are the same as in the first embodiment.

As can be readily understood from the foregoing description of the various embodiments of the invention, the invention has the advantages of finishing workpieces having a curved profile such as automobile fenders, with greater efficiency and certainty.

Although the invention has been described by way of the several preferred embodiments thereof, it should be noted that various changes and modifications may be made within the scope and spirit of the invention.

What I claim is:

1. A recipro-finishing method for finishing workpieces having a curved profile, comprising:

mounting the workpieces on mounting members which are pivotable around axes substantially coincident with the centers of curvature of the workpieces;

moving the mounting members and a mass of finishing medium relatively to each other for immersing the workpieces in the finishing medium; and linearly reciprocating the mounting members with the workpieces thereon in the finishing medium in a direction transverse to said axes and simultaneously rocking the mounting members back and forth around the pivoting axes thereof for moving the workpieces substantially along the curvature thereof.

2. A method as claimed in claim 1 further comprising the step of moving the mounting members and the mass of finishing medium relative to each other in a direction transversely to the direction of the linear reciprocation and to said axes.

3. A method as claimed in claim 1 in which the mounting members are rocked in a forward direction relative to the direction of linear reciprocation.

4. A recipro-finishing apparatus for surface finishing workpieces having a curved profile, comprising:

a carrying means having a plurality of workpiece mounting members thereon on which the workpieces can be mounted, said workpiece mounting members being mounted on said carrying means for pivotal movement around axes substantially coincident with the center of curvature of the workpieces when they are mounted on said workpiece mounting members, reciprocating means connected to said carrying means for reciprocating said carrying means linearly in a direction transverse to said axes, rocking means connected to said workpiece mounting members for rocking said workpiece mounting members back and forth around said axes during the linear reciprocation of said carrying means, and a finishing medium container for holding a mass of finishing medium and moving means connected to said finishing medium container for moving said finishing medium container toward and away from said carrying means for immersing the workpieces carried by said carrying means in the finishing medium during reciprocation and rocking of the workpieces.

5. An apparatus as claimed in claim 4 in which said carrying means has a magazine box having the top and bottom open, and a mounting member shaft extending across said magazine box, said workpiece mounting members being rigidly mounted on said shaft, and in which said rocking means comprises a blade extending in a direction across said magazine, a blade shaft on which said blade is mounted for pivoting movement around said shaft when said magazine is linearly reciprocated through a finishing medium, and a crank and link means connected between said blade and said mounting member shaft for rocking said mounting member shaft when said blade is pivoted around said blade shaft.

6. An apparatus as claimed in claim 4 in which said rocking means comprises an eccentric wheel mounted on said carrying means and means for rotating said wheel, and crank means connected between said eccentric wheel and said workpiece mounting members for rocking said workpiece mounting members during rotation of said eccentric wheel.

7. An apparatus as claimed in claim 6 in which said crank means comprises link means connected to said workpiece mounting members for simultaneously rocking said mounting members and further link means connected to said firstmentioned link means and said eccentric wheel, and connecting means connecting said link means and said further link means for easy connection and disconnection, whereby said crank means can be disconnected for easy removal of said workpiece mounting members from said apparatus.

8. An apparatus as claimed in claim 4 in which said carrying means has a magazine box having the top and bottom open, at least one mounting member shaft extending across said magazine box, said workpiece mounting members being rigidly mounted on said shaft, and said rocking means comprises link means connected between the respective mounting members and to a stationary point on said apparatus for rocking said mounting members by the motion of said link means as said carrying means is linearly reciprocated.

9. An apparatus as claimed in claim 8 in which said link means has connecting means connecting parts of said link means for easy connection and disconnection, whereby said link means can be disconnected for easy removal of said workpiece mounting members from said apparatus.

10. An apparatus as claimed in claim 4 in which said moving means for said finishing medium container further comprises means for automatically moving said finishing medium container toward and away from said carrying means during reciprocation of said carrying means and rocking of said mounting member.

* * * * *